US005393945A

United States Patent [19]

Joyce et al.

[11] Patent Number: 5,393,945

[45] Date of Patent: Feb. 28, 1995

[54] ADJUSTMENT MECHANISM FOR PRESSURE SWITCH

[75] Inventors: Ronald S. Joyce, Elk Grove Village; George Obermann, Niles, both of Ill.

[73] Assignee: Eaton Corporation, Cleveland, Ohio

[21] Appl. No.: 263,112

[22] Filed: Jun. 20, 1994

Related U.S. Application Data

[63] Continuation of Ser. No. 825,890, Jan. 27, 1992, abandoned.

[51] Int. Cl.[6] ..... H01H 35/24

[52] U.S. Cl. ..... 200/81 R; 200/83 WM; 200/83 SA

[58] Field of Search ..... 200/83 R, 83 A, 83 Q, 200/83 W, 83 S, 83 Z, 83 WM, 83 SA

[56] References Cited

U.S. PATENT DOCUMENTS 4,263,489 4/1981 Bergeson ..... 200/81 R 4,617,432 10/1986 Hanssen et al. ..... 200/81 R 4,629,837 12/1986 Carr ..... 200/50 C

*Primary Examiner*—A. D. Pellinen

*Assistant Examiner*—Michael A. Friedhofer

*Attorney, Agent, or Firm*—Roger A. Johnston

[57] ABSTRACT

A sliding type adjustment mechanism for changing settings of a diaphragm type pressure switch adjusted by moving an external lever to move a plunger for changing the preload on the diaphragm. An external metal mounting bracket has a pair of spaced parallel slots which serve as ways. A plastic slider with a cam surface engaging the lever has a pair of lugs, each of which engages one of the slots for guiding the slider on the bracket. The slider has an integrally formed spring tab providing friction against the bracket to hold the slider in a selected position. A recess in the bracket relieves the tab friction at the limit of the slider travel to allow the lever to bias a steep-ramp portion of the cam surface to move the slider to an initial position.

4 Claims, 2 Drawing Sheets

ADJUSTMENT MECHANISM FOR PRESSURE SWITCH

This application is a continuation of application Ser. No. 07/825,890, filed Jan. 27, 1992, now abandoned.

BACKGROUND OF THE INVENTION

The present invention relates to pressure switches of the type having a pressure-responsive member, typically a diaphragm movable in response to changes in a fluid pressure signal to actuate and de-actuate an electrical switch. Pressure switches of this type are typically employed for sensing relatively small changes in relatively low level pressure signals. A well known application of such pressure switches is that of sensing the pressure head resulting from the water fill in a washing machine for actuating or de-actuating an electrical switch to shut off the electrically controlled fill valve in the event of overfill. Pressure switches are also employed in washing machines to control the amount of water flow in response to a user selected level.

Pressure switches for the aforesaid appliance applications typically have an externally movable member or lever pivoted for movement to adjust the preload of a spring within the pressure switch for changing the switch actuation points. Various types of adjustment mechanisms have been employed, such as rotary cams and sliding cam mechanisms. In pressure switches employing a sliding type cam mechanism, it is common to provide a metal mounting bracket on the pressure switch housing which bracket has attached thereto a plastic slider which has lugs therein received through a slot in the bracket with a cam surface provided on the edge of the slider for contacting a movable lever on the pressure switch. Referring to FIGS. 6, 7, and 8, a known pressure switch indicated generally at 10 has a housing 12 which contains the sensing diaphragm responsive to pressures through signal port tube 14 and also contains electrical switching mechanism. A plunger 16 extends externally of the housing and is movable for adjusting the preload on an internal spring for changing the setting of the pressure switch. A metal mounting bracket 18 has a right angle flange 20 which is attached to the switch housing 12 for securing the bracket thereon. Bracket 18 has an elongated slot 22 formed therein with an enlarged portion 24 at one end thereof. A plastic slider 26 has a pair of spaced lugs 28 provided thereon which are inserted through the enlarged portion 24 of the slot and guide the slider on the edges of the slot 22. Slider 26 has a knob 30 thereon for facilitating user manipulation.

Slider 26 has a cam surface 32 formed on the edge thereof which engages a lever 34 which is pivoted on the upturned portion of flange 20 of the bracket by tab 36 engaged therewith and biased thereagainst by spring 38. An adjustment screw 40 is threaded through the lever 34 to contact the end of plunger 16 for effecting movement thereof to change the preload internally on the switching mechanism.

A slipper spring 42 has the ends thereof engaged through slots 44 formed in bracket 18. The slipper spring 42 provides frictional drag between the bracket and slider 26 to prevent the forces of the lever 34 acting against cam surface 32 from moving slider 26 once it has been placed in a desired position. The length of slipper spring 42 is chosen such that when the slider 26 is positioned as shown in FIG. 8, at the end of the cam surface 32 any contact of the lever 34 by the steep ramp portion 46 on the slider 26 effects movement of the slider in a rightward direction to seat the lever 34 at the end of the cam surface 32.

The arrangement of the prior art devices has resulted in unsatisfactory sliding operation of the member 26 in view of the close spacing of the lugs 28 required to give the amount of necessary movement of the slider in the available length of the slot 22. If the lugs 28 are spaced further apart, the slot 22 is required to have additional length and the bracket becomes prohibitively large extending beyond the envelope of the switch housing by an amount which requires additional space for mounting the unit 10.

Furthermore, the close spacing of the lugs has resulted in a tendency for the slider to rotate in the slot and bind during user movement of the slider.

It has thus been desired to find a way or means of providing an adjustment mechanism for a pressure switch which provides ease of adjustment for the user and which is compact and low in manufacturing cost, yet provides stable and smooth adjustment without binding.

SUMMARY OF THE INVENTION

The present invention provides an adjustment mechanism for a pressure switch of the type having a movable member exposed externally of the switch housing and operable upon movement to change the actuation setting of a switch in the housing. The mechanism of the present invention includes a bracket attached externally to the switch housing and supporting the fulcrum of the member movable for effecting changes in the switch setting. A user-movable slider mounted on the bracket has a cam surface contacting and moving the adjustment member upon user movement thereof. The mounting bracket has a pair of elongated slots disposed in spaced parallel relationship with enlarged portions at the ends to permit the mounting and removal of the slider on the bracket. The slider has a pair of spaced lugs which are inserted through the enlarged portions of the slots and each lug engages the sides of one of the slots which act as ways for guiding the slider on the bracket. The slider has integrally formed therewith a tab or spring portion which provides a desired amount of friction between the slider and the bracket to prevent the forces of contact by the cam surface on the adjustment member from moving the slider after it has been positioned by the user. The adjustment mechanism of the present invention permits the slider, including the cam surface and the integrally formed spring tab to be molded in one piece from a suitable plastic material, and is designed to operate against metal surfaces in the slots on the bracket. The adjustment mechanism of the present invention has a relief portion provided on the bracket such that the integral spring tab is received therein at the limit of the slider movement to relieve the friction forces such that the cam surface is operable to bias the slider to a desired position at the limit of its travel.

DETAILED DESCRIPTION

Figure 3:
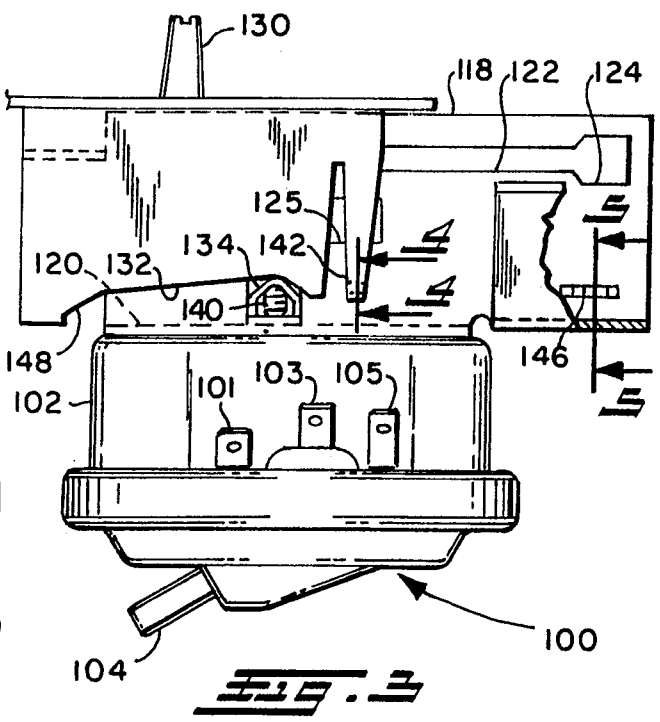
FIG. 3 is a right-hand view of the embodiment of FIG. 1.

Referring to FIGS. 1 through 4, the present invention is shown as installed on a pressure switch indicated generally at 100 as a housing 102 containing a pressure-responsive mechanism which responds to a pressure signal at the inlet port provided in tube 104. The housing also contains an electrical switching mechanism (not shown) connected to external electrical connector terminals 101,103,105, which extend externally from the housing. The switching mechanism is preloaded by a plunger 106 which extends externally of the housing.

A mounting bracket 118 having a right angle flange 120 is rigidly attached to the exterior of the housing. The bracket 118 has a pair of elongated slots 122,123 formed therein and disposed in spaced parallel arrangement. Each of the slots has at a common end thereof an enlarged portion, denoted respectively 124,125.

A slider member 126 is received on the bracket 118; and, the slider 126 has a pair of spaced lugs 128 extending therefrom which engage the sides of the slots, respectively, 122,123 which act as ways for guiding the movement of the slider 126 in the slots. The slider is assembled by inserting the lugs 128 through the enlarged portions 124,125 of the ends of the slots and moving the slider to engage the lugs 128 in the slots 122, 123. Slider 126 has a knob 130 provided thereon for facilitating ease of user movement of the slider.

The slider 126 has a cam surface 132 formed on the lower edge thereof which engages an adjustment lever 134 which is pivoted on the mounting bracket flange 120 by a tab 136 which is received through aperture 135 provided in the upturned end of flange 20. Lever 134 is biased against the cam surface 132 by a spring 138 and has an adjustment screw 140 received therein for contacting the surface of the plunger 106.

Figure 4:
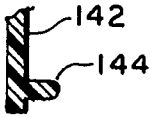
FIG. 4 is a portion of a section view taken along section-indicating lines 4—4 of FIG. 3.
Figure 8:
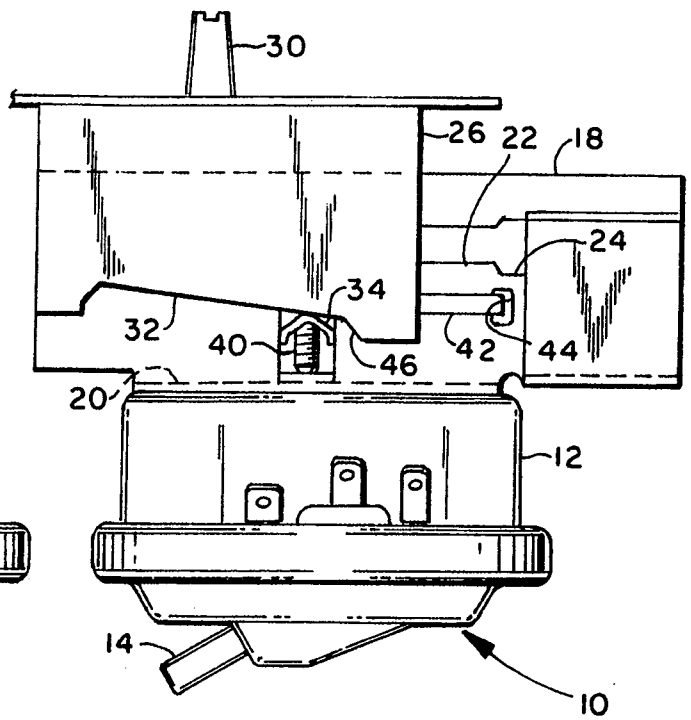
FIG. 8 is a right-hand view of the known device of FIG. 6.
Figure 6:
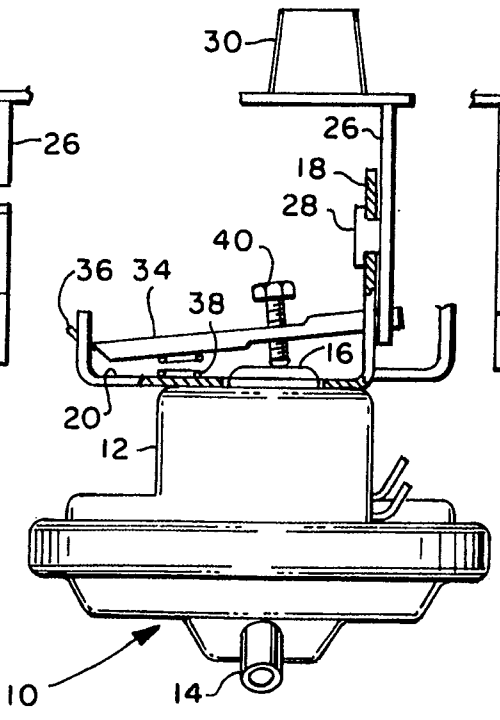
FIG. 6 PRIOR ART
FIG. 6 is a view similar to FIG. 1 of pressure switches known in the art.
Figure 7:
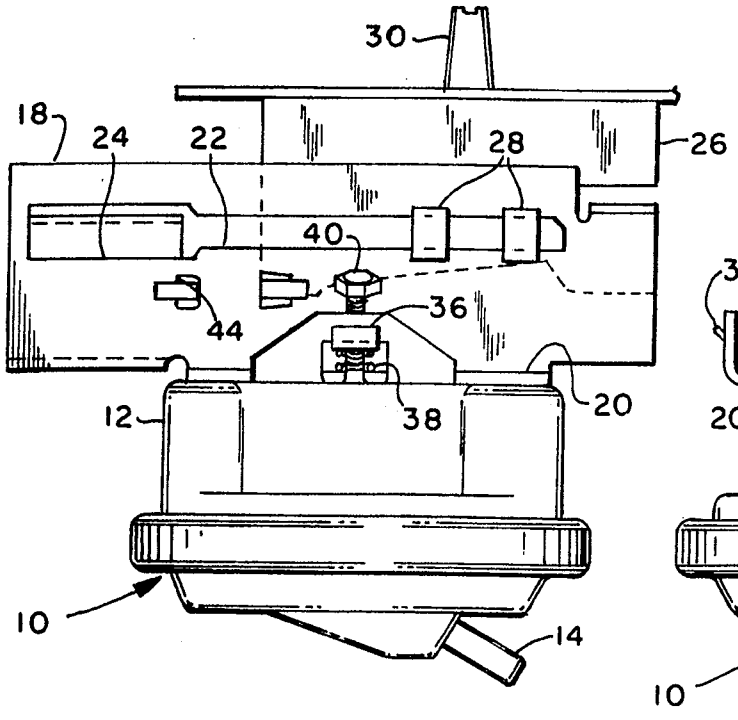
FIG. 7 is a left-hand view of the device of FIG. 6.

Referring to FIGS. 3 and 4, slider 126 has an integrally-formed tab 142 provided thereon, which has a lug or foot 144 provided thereon as shown in FIG. 4. The tab 142 engages the surface of bracket 118 and provides a frictional resistance to movement of slider 126 on the bracket 118.

Figure 5:
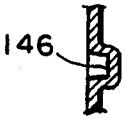
FIG. 5 is a portion of a section view taken along section-indicating lines 5—5 of FIG. 3.
Figure 1:
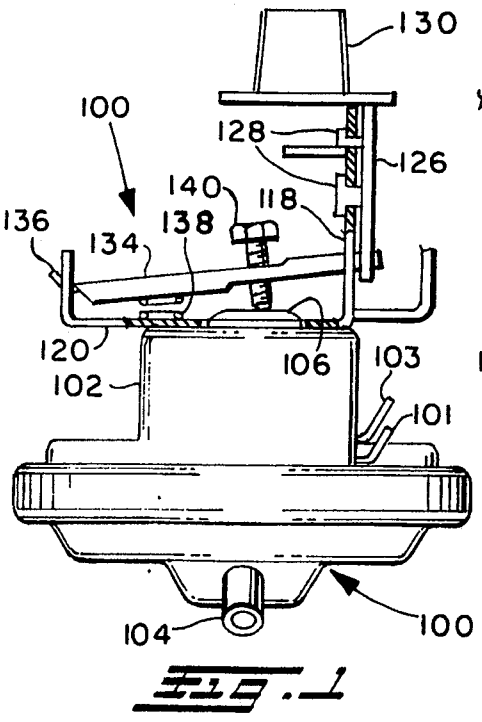
FIG. 1 is a side elevation view of the pressure switch of the present invention.
Figure 2:
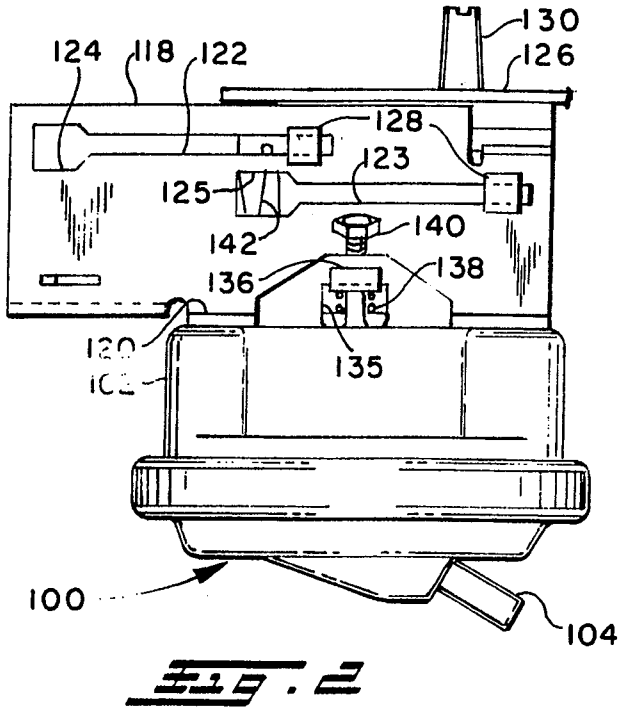
FIG. 2 is a left-hand view of the embodiment of FIG. 1.

Referring to FIGS. 3 and 5, the dimple or recess 146 is formed in the bracket 118 at a location such that when slider 126 is moved to the limit of its travel in a rightward direction in FIG. 3, the lug 144 is depressed into the recess 146 relieving the friction of the tab on the bracket. When the tab 142 is received in recess 146, the steep ramp portion 148, located at the leftward end of cam surface 132, contacts lever 134, which portion 148 transmits the bias load of the spring on adjustable member 134 to the ramp 148 and urges the slider 126 in a leftward direction until the adjustment member 134 rests against the slope of the cam surface 132. Further leftward movement of the slider from this latter position causes tab 142 to be lifted out of recess 146 and onto the surface of the bracket 118 to provide sufficient friction to hold the slider 126 in the user selected position.

The present invention thus provides a sliding adjustment mechanism for a pressure switch, which mechanism is low in manufacturing cost, easy to assemble, and stable in its adjusted position, and yet provides ease of sliding adjustment by the user. The present invention employs a plastic slider having lugs engaging a pair of elongated spaced parallel slots provided on a metal mounting bracket attached to the pressure switch housing. The plastic slider has an integrally formed spring tab thereon which provides frictional resistance to movement of the slider to prevent the bias forces on the cam face of the slider engaging the switch adjustment lever from moving the slider from the selected position. Upon the slider being moved to the limit of its adjustment position, the spring tab engages a recess which releases the frictional forces to permit the bias forces of the adjustment member to move the cam to a desired initial position.

Although the invention has hereinabove been described with respect to the illustrated embodiments, it will be understood that the invention is capable of modification and variation within the purview of the following claims, and is intended as limited only by the scope of such claims.

We claim:

1. In a pressure switch having an adjustment member movable externally with respect to the pressure switch housing for adjusting actuation settings the improvement comprising:

(a) bracket means attached to said pressure switch housing, said bracket means defining a pair of spaced parallel guide ways and detent means thereon;

(b) slider means disposed for sliding movement on said ways, said slider means defining an adjustment cam surface operable to contact said adjustment member, and defining integrally therewith (i) lug means engaging each of said ways and slidably retaining said slider means on said bracket means, (ii) spring means operable to maintain desired minimum friction forces resisting said movement of said slider means and said bracket means, said spring means further operable to engage said detent means at a predetermined position of said slider means for releasing said friction forces.

2. The improvement defined in claim 1, wherein said bracket means is formed of metallic material and said slider means comprises a unitary member formed of non-metallic material.

3. The improvement defined in claim 1, wherein said ways comprise a pair of elongated slots formed in said bracket means.

4. The improvement defined in claim 1, wherein said guide ways comprises a pair of elongated slots having enlarged portions formed at a selected location thereon to permit free passage of said lug means therethrough for removal and assembly of said slider means on said bracket means.

* * * * *